United States Patent [19]

Fosella

[11] Patent Number: 5,076,121

[45] Date of Patent: Dec. 31, 1991

[54] ADJUSTABLE RATCHET WRENCH

[76] Inventor: Gregory Fosella, 97 Main St., Osterville, Mass. 02655

[21] Appl. No.: 657,931

[22] Filed: Jan. 14, 1991

Related U.S. Application Data

[63] Continuation of Ser. No. 387,220, Jul. 28, 1989, abandoned.

[51] Int. Cl.[5] ..... B25B 13/00

[52] U.S. Cl. ..... 81/58.4; 81/63.2

[58] Field of Search ..... 81/58.4, 60–63.2, 81/128

[56] References Cited

U.S. PATENT DOCUMENTS

| | | | |
|---|---|---|---|
| 877,773 | 1/1908 | Holm . | |
| 912,117 | 2/1909 | Green | 81/128 X |
| 915,443 | 3/1909 | Jones | 81/128 X |
| 1,000,277 | 8/1911 | McCoy | 81/62 |
| 1,074,594 | 10/1913 | Andersen | 81/62 |
| 1,274,337 | 7/1918 | Schwartz | 81/62 |
| 1,450,641 | 4/1923 | Ograbisz . | |
| 2,580,247 | 12/1951 | Secondi et al. . | |
| 3,377,893 | 4/1968 | Shorb . | |
| 3,664,213 | 5/1972 | Anati . | |

*Primary Examiner*—James G. Smith

*Attorney, Agent, or Firm*—Wolf Greenfield & Sacks

[57] ABSTRACT

An adjustable ratchet wrench has a housing carried by a handle. The housing has a generally cylindrical chamber which carries a disc which in turn supports three equidistantly spaced jaws. The mounting disc is connected to the handle by a ratchet assembly whose setting determines the direction in which the tool may be used to turn the nut or other workpiece. The housing also carries a cam disc that engages the jaws and opens and closes them depending upon the direction in which it is rotated. A second ratchet mechanism determines the direction in which the cam disc may be rotated with respect to the mounting disc so as to open and close the jaws.

22 Claims, 7 Drawing Sheets

ADJUSTABLE RATCHET WRENCH

This application is a continuation of application Ser. No. 07/387220, filed Jul. 28, 1989 abandoned.

INTRODUCTION

This invention relates to ratchet wrenchs and more particularly comprises a new and improved adjustable ratchet wrench capable of use with a large range of sizes of nuts and bolts.

Most conventional ratchet wrenchs in use today require a large number of interchangeable heads so as to accommodate workpieces of different diameters. For example, approximately 41 different heads are required to accommodate both standard and metric sizes within the range of from 5/16 to 1 inch in diameter. An additional equal number of heads may be required if deep bolt clearance is necessary for the work to be performed. A complete set of sockets is expensive, bulky and heavy to carry about, and are very easily lost.

The principal object of the present invention is to provide an adjustable ratchet-type socket wrench capable of accommodating a wide range of sizes of nuts and bolts.

Another important object of the present invention is to provide an adjustable ratchet-type socket wrench which has an open center so as to provide deep bolt clearance.

Yet another important object of the present invention is to provide an adjustable ratched-type socket wrench which may not only be used directly on work but may be used in combination with other tools such as screwdrivers and standard square drive socket extension bars, sockets and other square drive accessories.

To accomplish these and other objects the adjustable ratchet wrench of the present invention has three radially moveable jaws that may be moved toward and away from one another by means of a rotatable cam disc carried on the head of the tool and which is controlled by a conveniently placed rocker pawl on the upper surface of the head of the tool. A second ratchet assembly controls the drive direction of the head with respect to the handle so that the work may be rotated either clockwise or counterclockwise. The tool is open through the center so that a nut can be screwed onto a shaft or other member of any length and to any depth.

These and other objects and features of the present invention will be better understood and appreciated from the following detailed description of one embodiment thereof, selected for purposes of illustration and shown in the accompanying drawings.

BRIEF FIGURE DESCRIPTION

DETAILED DESCRIPTION

Figure 1:
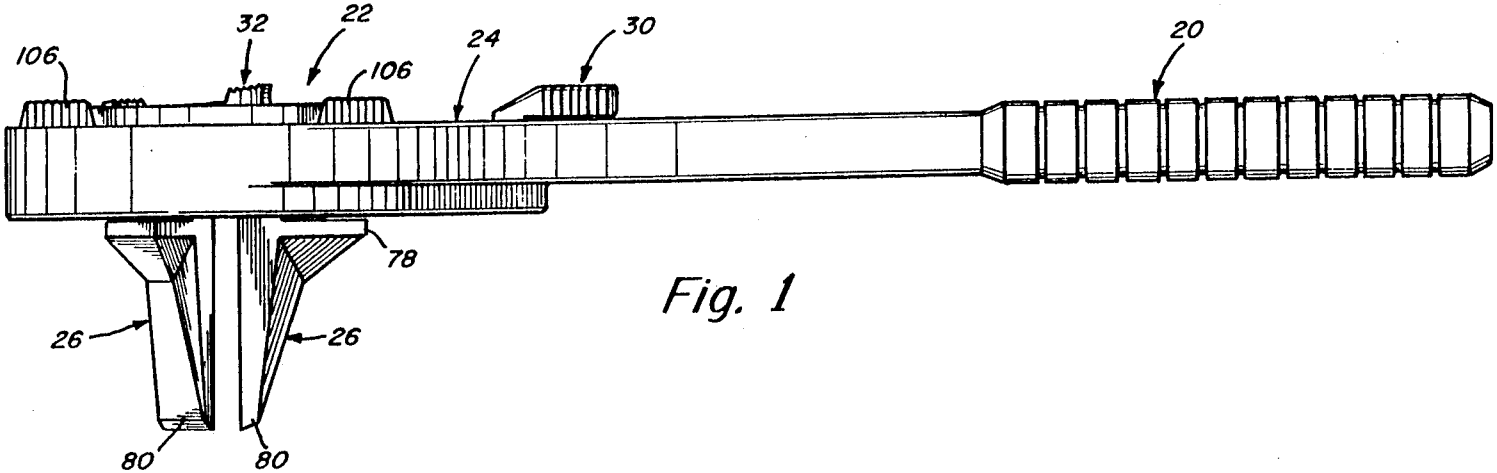
FIG. 1 is a side view of an adjustable ratchet wrench constructed in accordance with this invention.

The adjustable ratchet wrench shown in the drawings has a handle 20 and head 22. The head 22 is mounted on the shallow housing 24 which is integrally formed with the handle. The head in the embodiment shown carries three adjustable jaws 26 spaced equally about the head for radial movement with respect to the head axis 28. A pair of ratchet mechanisms 30 and 32 associated with head 22 are shown in FIG. 1. The ratchet mechanism 30 interconnects the handle 20 and housing 24 with the jaws so that rotation of the housing will cause the jaws 26 to turn the workpiece engaged by them. The ratchet mechanism 32 is used in adjusting the jaw positions so as to open and close them on the work. In the following description the various part of the wrench are described in detail.

Figure 3:
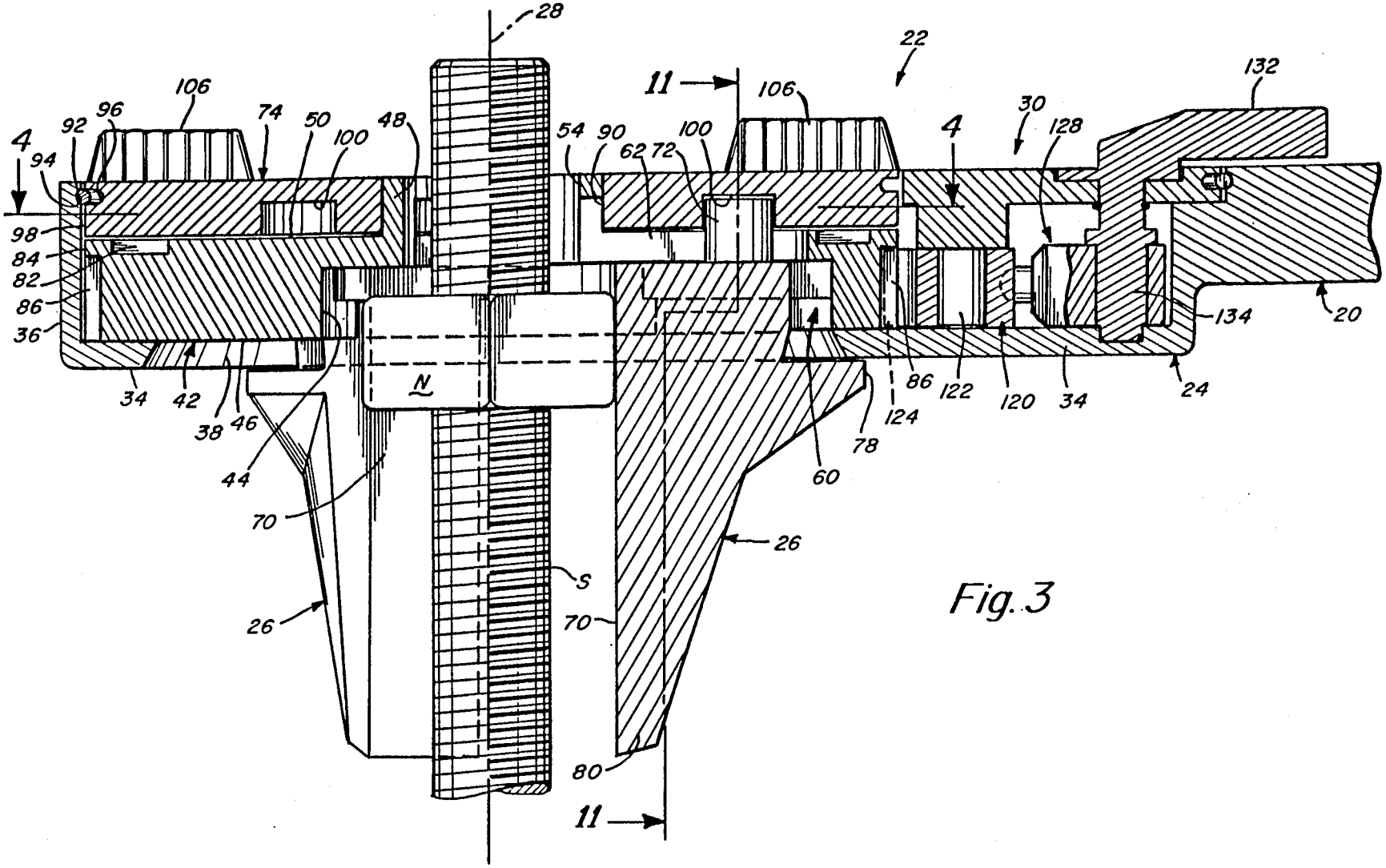
FIG. 3 is an enlarged fragmentary cross sectional view of the head of the adjustable ratchet wrench shown in FIGS. 1 and 2.

The housing 24 most clearly shown in FIG. 3 has a bottom wall 34 and a peripheral side wall 36 that together define a shallow chamber within which the various parts of the head 22 are assembled. An opening 38 is provided in the bottom wall 34 of the housing concentric with the axis 28, and the housing is open at the top.

Figure 11:
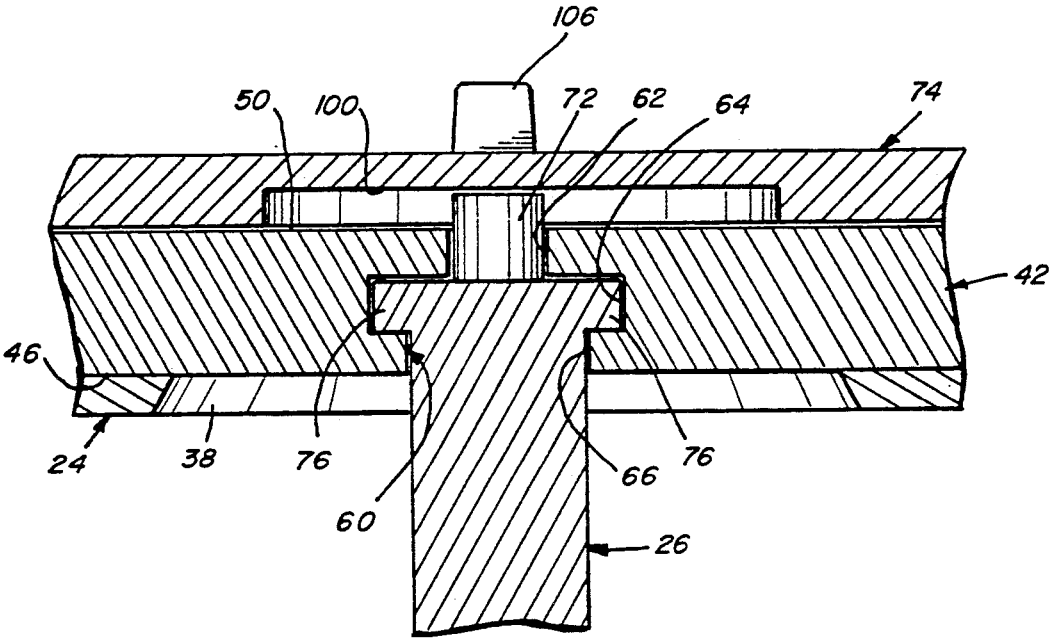
FIG. 11 is a fragmentary cross-sectional view of the head of wrench taken along section line 11—11 in FIG. 3.

A first annular disc 42 is disposed in the housing 24 and has a central opening 44 extending upwardly from its bottom surface 46. A collar 48 extends upwardly from the upper surface 50 of the disc 42 and define an extension 54 of opening 44. The disc is provided with three radial slots 60 shown in FIGS. 3, 5, and 11, spaced equidistantly about the axis 28, and each terminates at its inner edge at the openings 44 and 54. As best shown in FIG. 11 each slot 60 includes an upper portion 62 that extends through the surface 50, a midsection 64 of greater width than the upper portion 62, and a lower portion 66 which is wider than the top portion 62 and narrower than the midsection 64. Each slot 60 carries a jaw 26 and permits the jaw to move radially in and out with respect to the axis 28.

Figure 7:
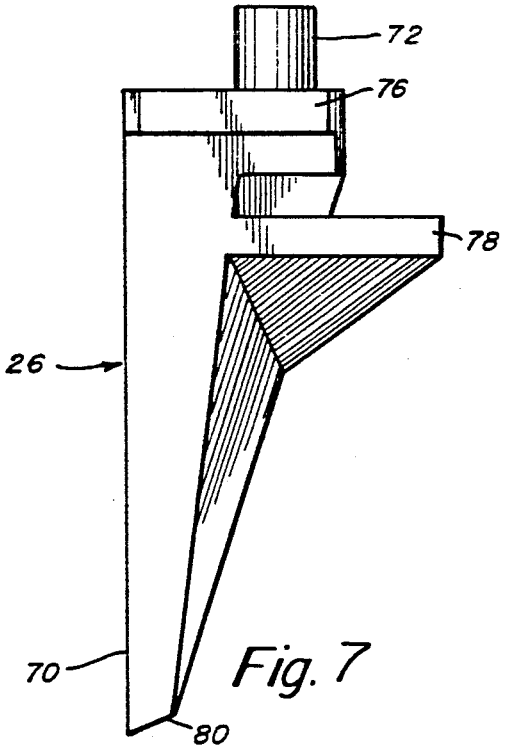
FIG. 7 is a side elevation view of one jaw of the wrench.
Figure 8:
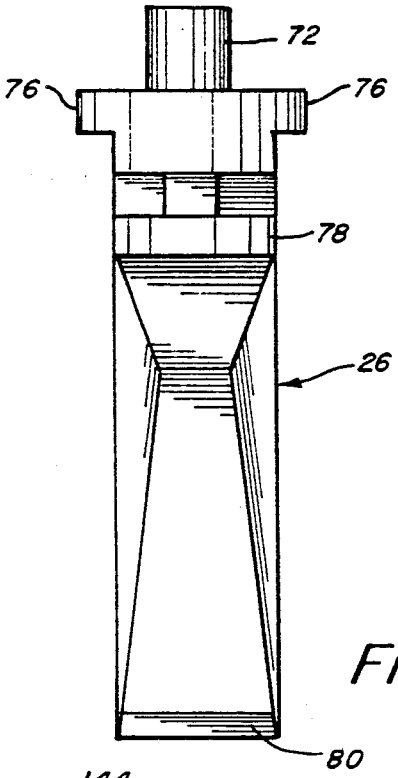
FIG. 8 is a rear view of the jaw shown in FIG. 7.

As shown in FIGS. 3 and 7 each of the jaws 26 has a gripping face 70 which may be knurled or otherwise textured so as to enable the jaw to firmly engage a workpiece such as a nut N to be turned by the wrench. Each jaw also includes a post 72 that serves as a cam follower and extends upwardly at the top of the jaw and through the upper portion 62 of the slot 60 and is engaged by a cam in a cam disc 74 which is described in detail below. Beneath post 72 each jaw carries a pair of outwardly extending flanges 76 that are disposed in the midsection 64 of slot 60. The flanges 76 cooperate with the wider midsection 64 of the slot to retain the jaw in the first disc 42.

Each jaw 26 also includes a rear flange 78 that is disposed beneath the lower surface of housing bottom wall 34 and serves to close or cover the opening 38 when the jaws are closed. The rear flange 78 together with the side flanges 76 and the post 72 in the cam disc 74 prevent the jaw from pivoting or twisting with respect to the axis 28 and maintain the face 70 parallel to it. The lower portion 80 of each jaw is tapered to a minimum thickness at its lower end so as to enable the jaws to reach and engage a workpiece located in a confined area. The taper of the lower portion 80 of each jaw is clearly shown in FIGS. 1, 3 and 7. The gripping faces 70 are of uniform width throughout their full height.

The upper surface 50 of the first disc 42 is provided with a circular rack 82 about its periphery (see FIG. 5), which forms part of the second ratchet mechanism 32. The outer edge 84 of disc 42 is also provided with a circular gear 86 that forms part of the first ratchet mechanism 30. The ratchet mechanisms are also described in detail below.

The cam disc 74 is disposed in the chamber of housing 24 above the first disc 42 and is rotatable with respect thereto. The cam disc 74 has a central opening 90 that surrounds collar 48. The cam disc 74 serves as a cover for the chamber within the housing and is held in place by a retaining ring 92 which registers with opposed recesses 94 and 96 in the cylindrical wall 36 and the outer edge 98 of cam disc 74, respectively. Three cam slots 100 in disc 74 overlie and cross the radial slots 60 in the first disc 42. The end 102 of each slot 100 lies closer to the head axis 28 than does the other end 104 of each slot, and each slot receives the post 72 of one of the jaws 26. It is evident upon an inspection of FIGS. 3 and 4 that rotation of the cam disc 74 will cause the jaws to move radially in the slots 60 under the influence of the cam slots 100 acting on the posts 72. When the cam disc 74 is rotated clockwise as viewed in FIG. 4, the jaws will move radially outwardly away from the axis 28, while counter clockwise rotation will cause the jaws to move toward the axis. To facilitate rotation of the cam disc 74, a pair of thumb and finger engaging ribs 106 are provided on its upper surface (see FIGS. 1 and 3).

Figure 5:
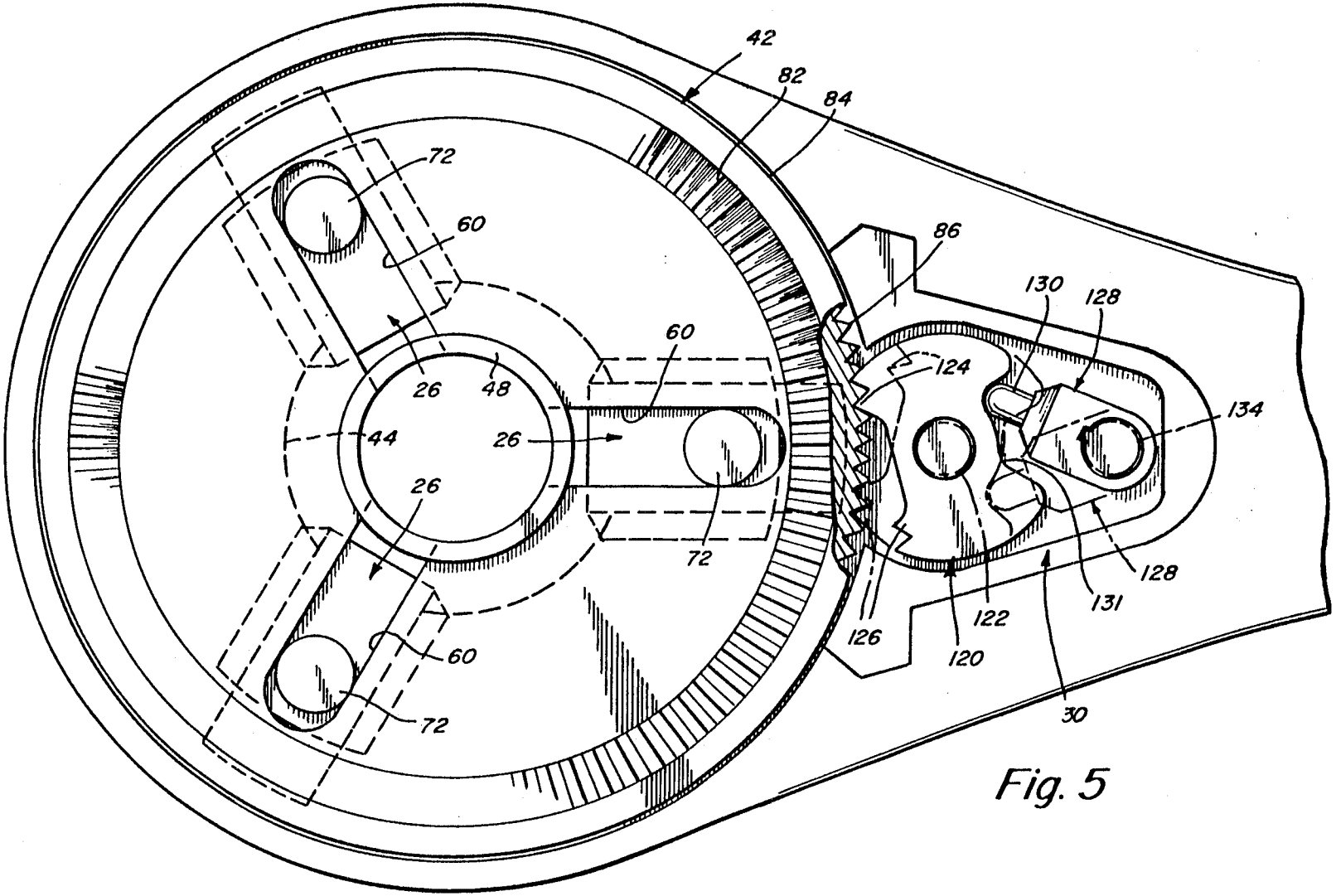
FIG. 5 is a plan view of the head of the wrench shown in FIG. 3 with the cam plate removed.
Figure 6:
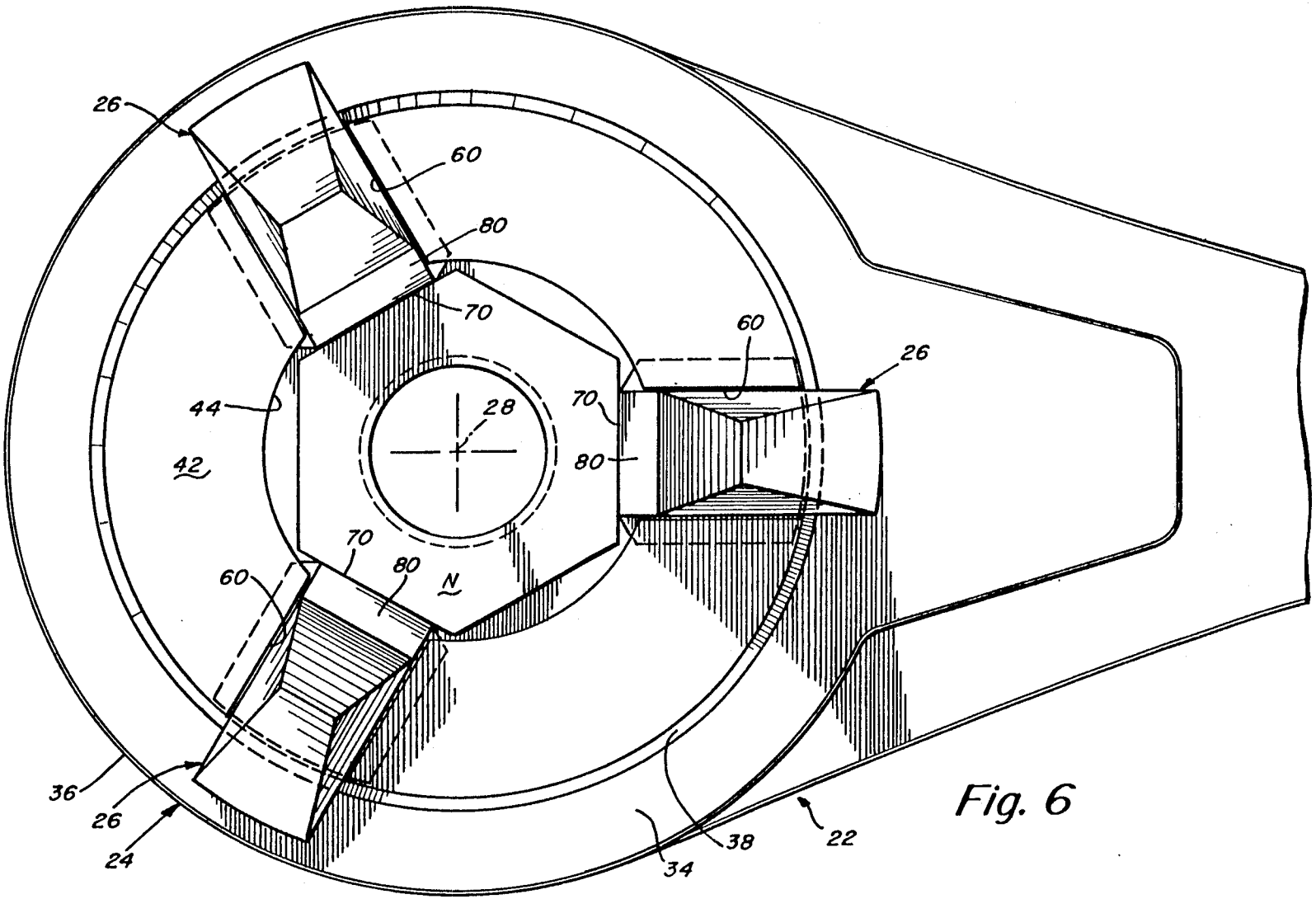
FIG. 6 is a bottom plan view of the head of the wrench showing the jaws of the wrench engaging a large hexagonal nut.

The first ratchet mechanism 30 selectively interconnects the housing 24 with the first disc 42 so that rotation of the housing may rotate the first disc which in turn will rotate the jaws about the axis 28 so that they may turn the workpiece such as nut N shown in FIGS. 3 and 6 to screw it on or off the threaded shaft S. The ratchet mechanism 30 is shown in FIGS. 3 and 5. The mechanism 30 includes a pawl 120 pivotally carried on a shaft 122 and having teeth 124 and 126 at each side that may selectively engage the circular gear 86 on the periphery of the first disc 42. The position of the pawl 120 is controlled by a detent 128 in turn controlled by the lever 132. The lever 132 has a stem 134 on which the detent 128 is keyed. The lever 132 as viewed in FIG. 1 is disposed above the end of handle 20 adjacent the working head 22 of the wrench.

Figure 2:
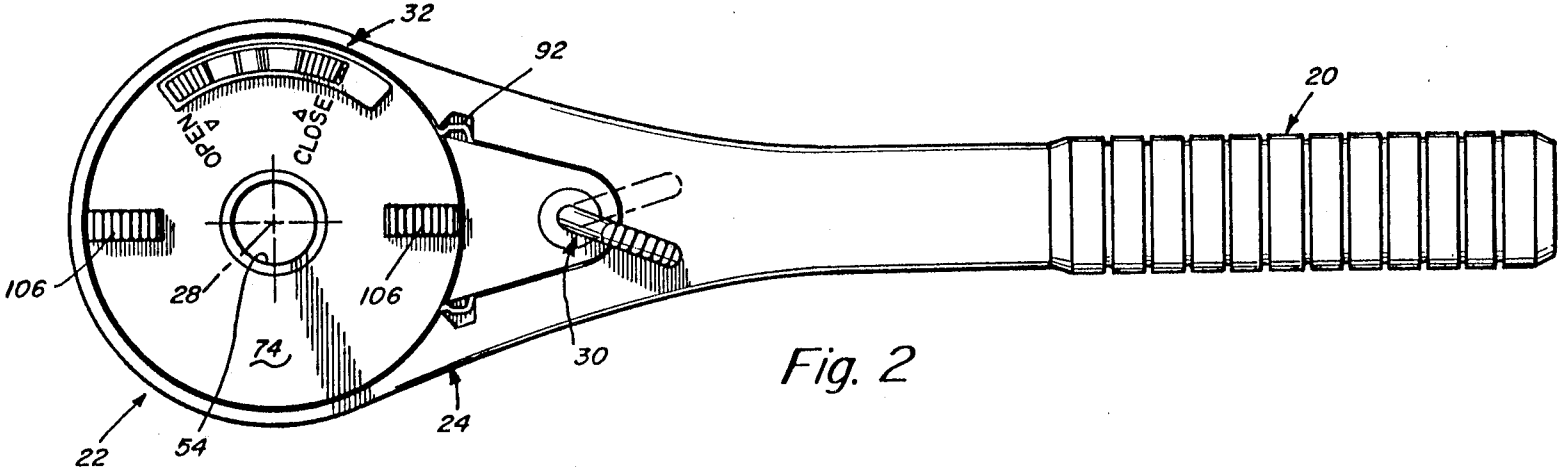
FIG. 2 is a top view thereof.

The detent 128 carries a spring loaded plunger 130 that engages one or the other of the ends of slot 131 in the side of panel 120 facing away from the circular gear 86. By pivoting the lever 132 between its two positions suggested in FIG. 2, the detent 128 with its plunger 130 may be moved between the two positions suggested in solid and broken lines in FIG. 5. When the pawl 120 is in the position shown in full lines in FIG. 5, counterclockwise rotation of the handle will cause the pawl to remain engaged with the gear 86 so that the first disc 42 will rotate with it. That action will in turn carry the jaws in the same direction and will rotate the work engaged by the jaws in a counter-clockwise direction. With the pawl in the same position, clockwise rotation of the handle as viewed in FIG. 5 will cause the pawl to ride over the teeth as the plunger 130 moves in and out of the detent 128. Thus, the first disc 42 may be turned continuously in a counterclockwise direction by the handle 20, and the handle may click clockwise to enable the operator to reset the handled position. To rotate the first disc 42 in a clockwise direction, the position of the detent 128 is reversed by means of lever 132 so as to lie in the broken line position of FIG. 5. In that position, clockwise rotation of the handle 20 will cause the first disc 42 to rotate in the same direction, but the pawl 120 will be allowed to click over the circular gear 86 when the handle is turned counterclockwise. Thus, the operator may selectively position the ratchet mechanism so as to afford either clockwise or counterclockwise rotation of the nut N engaged by the wrench.

Figure 4:
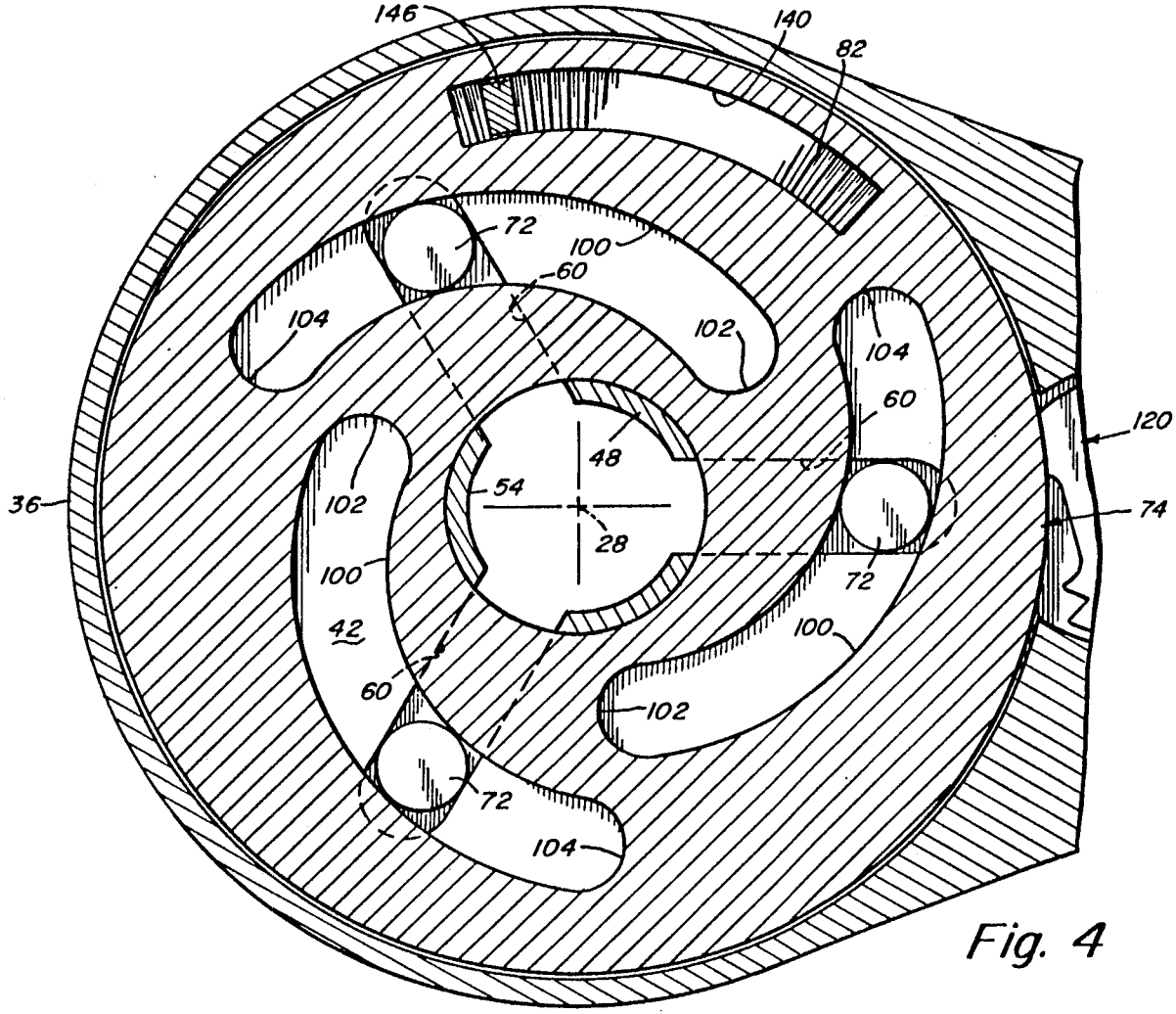
FIG. 4 is a fragmentary cross sectional view of the head of the wrench taken along the section line 4—4 in FIG. 3.
Figure 9:
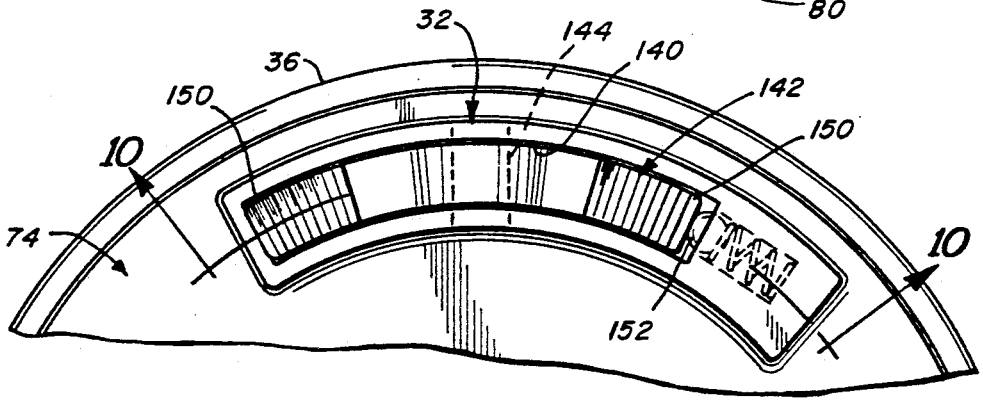
FIG. 9 is an enlarged fragmentary plan view of the head of the wrench and particularly showing the ratchet control for the adjustment of the jaws.
Figure 10:
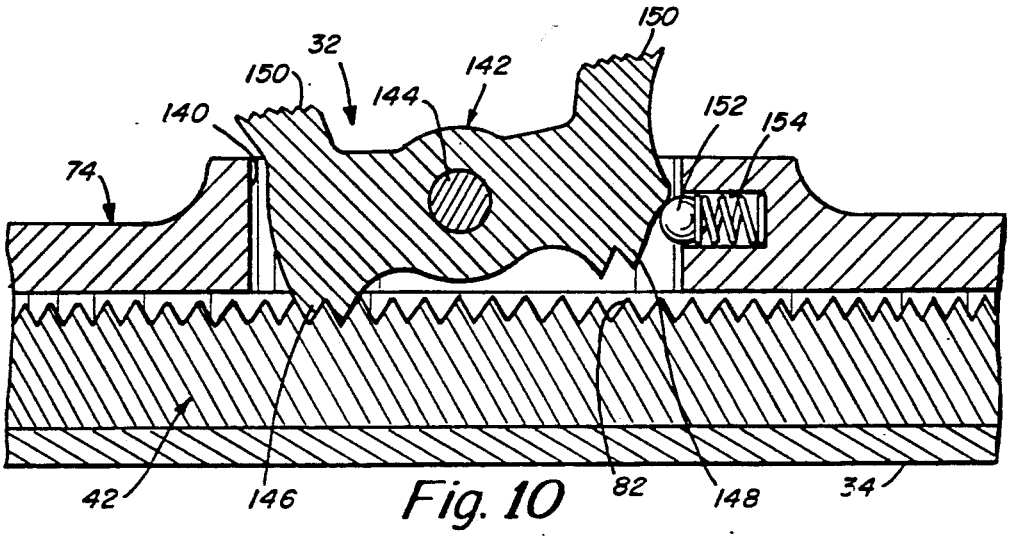
FIG. 10 is a fragmentary cross-sectional view of the ratchet control taken along the section line 10—10 in FIG. 9.

The second ratchet mechanism 32 is shown in FIGS. 4, 9 and 10. In FIG. 4 an arcuate slot 140 is shown provided in the cam disc 74. The slot 140 overlies the circular rack 82 on the upper surface of the first disc 42 and contains a locking pawl 142 which rocks on a horizontal shaft 144 that spans the slot 140. The locking pawl 142 has downwardly facing teeth 146 and 148 at its ends, which may selectively engage the teeth of the circular rack 82. A pair of knurled ears 150 are provided on the upper surface of the locking pawl 142 to facilitate pivoting of the pawl on its shaft 144. A ball detent 152 mounted in a recess 154 formed in the cam disc 74 at the end of slot 140, engages the right end of the locking pawl 142 as viewed in FIGS. 9 and 10.

With the locking pawl 142 in the position of FIG. 10 (teeth 146 engaging rack 82), the cam disc 74 may be rotated in a clockwise direction which will cause the jaws 26 to open. Moreover, in that position the jaws cannot be forced closed. When the pawl 142 is reversed so that its teeth 148 engage the rack 82, the cam disc may be rotated counterclockwise to close the jaws on a workpiece. When the jaws engage the workpiece, with the pawl 142 remaining in the position wherein its teeth 148 engage the rack 82, the jaws will lock in place.

From the foregoing description, it is evident that the two easy-to-use ratchet mechanisms 30 and 32 conveniently accessible to the user enable the tool to rotate a workpiece either in a clockwise or counterclockwise direction and also permit the tool to be tightened onto and removed from the workpiece. The jaws 26 which extend beneath the head of the tool have an effective diameter very slightly greater than the set opening within the jaws and, therefore, the jaws are capable of engaging workpieces in remote locations having a minimum of clearance with other parts of the device on which the workpiece is being turned. Furthermore, the single adjustable ratchet wrench of this invention can very conveniently be made to accommodate the most popular size nuts and bolts such as from 5/16 inch to 1 inch as well as all the metric and standard sizes within the range. It will also be appreciated that because the tool is open at the center above the jaws, the threaded portion of a bolt onto which a nut is being turned may extend through the tool so as to give it the same versatility as a deep bolt socket.

Yet another advantage derived from this invention is that the tool ha provides three jaws that firmly grip the work on its flat faces so as to eliminate the problem of wearing off the corners of the work or disturbing the work plating.

It will also be appreciated that the tool is particularly easy to operate because the three jaws are simultaneously adjusted by the ratchet system which also automatically locks the jaws in place when they engage the workpiece. And simply by reversing a control lever, the jaws may readily be opened so as to free the tool from the work.

The open center configuration of the head of the tool in combination with the adjustable locking jaws makes the tool particularly effective for use in combination with other tools. For example, a screwdriver having a hexagonal shaft may be inserted through the open jaws and the jaws may then be closed about the shaft. With the tool locked on the screwdriver in that manner, the screwdriver may be turned with one hand by means of the tool handle while the screwdriver itself may be steadied by the other hand of the user engaging the screwdriver handle. The tool of this invention may also be used in combination with standard square drive socket extension bars, sockets, or other square drive accessories by inserting their shafts through the tool head within the jaws and tightening the jaws on the shaft.

Finally, it will be appreciated that the tool of the present invention is capable of performing all the functions of conventional ratchet wrenches having separate heads for each size nut or bolt and both open and closed sockets. Thus, the present invention is capable of performing the work of ratchet wrenches that include approximately 82 different sockets ranging in size from 5/16 to 1 inch.

From the foregoing description those skilled in the art will appreciate that numerous modifications may be made of this invention without departing from its spirit. Therefore, it is not intended that the breadth of this invention be limited to the single embodiment illustrated and described. Rather, it is intended that the scope of this invention be determined by the appended claims and their equivalents.

I claim:

1. An adjustable ratchet wrench comprising a housing having a handle extending from one side thereof for rotating the housing, said housing having a generally cylindrical chamber therein with its axis generally perpendicular to the plane of the handle, a first disc mounted concentrically in the chamber and rotatable with respect thereto about the axis, a first ratchet mechanism interconnecting the housing and the first disc enabling the first disc to be selectively locked to the housing for clockwise or counterclockwise rotation therewith about the axis, a plurality of radially oriented slots in the disc and a jaw slidably mounted in each slot to move radially inwardly and outwardly in the slot; each of said jaws having a gripping surface facing the axis, a second disc disposed concentrically in the chamber and rotatable with respect to the housing and first disc, said second disc having a plurality of cam slots that correspond in number to the radial slots in the first disc, said cam slots each having an inner end that lies closest to the axis and an opposite end that lies farthest away from the axis, a stem carried by each of the jaws and extending into one of the cam slots whereby rotation of the second disc relative to the first disc in one direction closes the jaws and in the other direction opens the jaws, and a second ratchet mechanism interconnecting the second disc with the first disc enabling the second disc to rotate selectively either clockwise or counterclockwise with respect thereto.

2. An adjustable ratchet wrench as defined in claim 1 wherein the housing, first disc and second disc are open at the center for enabling a portion of the work gripped by the jaws to extend through the wrench.

3. An adjustable ratchet wrench as defined in claim 1 wherein means are carried by the jaws and engaging the slot in the first disc causing the jaws to rotate about the axis with the first disc.

4. An adjustable ratchet wrench as defined in claim 1 wherein means are provided on the second disc to facilitate rotating that disc relative to the first disc to open and close the jaws.

5. An adjustable ratchet wrench as defined in claim 1 wherein the second disc overlies the first disc, and the cam slots are provided in the lower surface of the second disc.

6. An adjustable ratchet wrench as defined in claim 5 wherein means are provided in the upper surface of the second disc for facilitating rotation of the second disc relative to the first disc to open and close the jaws.

7. An adjustable ratchet wrench comprising a generally cylindrical shallow housing having a central axis and carrying a handle extending generally radially from the housing with respect to the axis, said housing being open at the top and the bottom, at least two jaws mounted in the housing and having gripping faces which face the axis and extend out the open bottom of the housing, jaw control means disposed in the housing for limiting the jaws to radial movement with respect to the housing for enabling the jaws to open and close about a workpiece disposed coaxially between the gripping faces, cam means disposed in the housing for moving the jaws radially to open and close them about a workpiece, a first ratchet mechanism for locking and unlocking the cam means to the jaw controls means, and a second ratchet mechanism for alternately locking the housing to the jaw control means for rotation in a clockwise or counterclockwise direction therewith.

8. An adjustable ratchet wrench as defined in claim 7 wherein the jaw control means, cam means and housing are open at the center so that a workpiece engaged by the jaws may extend upwardly through the wrench.

9. An adjustable ratchet wrench comprising a housing having a handle extending therefrom for rotating the housing, said housing having an axis about which it is turned by the handle, a first rotatable member mounted concentrically in the housing and rotatable with respect thereto about the axis of the housing, a first mechanism interconnecting the housing and the rotatable member enabling the rotatable member to be selectively locked to the housing for clockwise or counterclockwise rotation therewith about the axis of the housing, a plurality of generally radially oriented slots in the first rotatable member and a jaw slidably mounted in each slot to move inwardly and outwardly with respect to the housing axis, each of said jaws having a gripping surface facing the axis, a second rotatable member disposed concentrically in the housing and rotatable with respect to the housing and first rotatable member, said second member having a plurality of cam slots that correspond in number to the radial slots in the first member, said cam slots each having an inner end that lies close to the housing axis and an opposite end that lies farther away from the axis, a stem carried by each of the jaws and extending into one of the cam slots whereby rotation of the second rotatable member relative to the first member in one direction closes the jaws and in the other direction opens the jaws, and a second mechanism connecting the second rotatable member with the first rotatable member enabling the second member to rotate selectively either clockwise or counterclockwise with respect thereto.

10. An adjustable ratchet wrench comprising a housing having a handle extending therefrom for rotating the housing, said housing having an axis about which it is turned by the handle, a first rotatable member mounted concentrically on the housing and rotatable with respect thereto about the axis of the housing, a first mechanism interconnecting the housing and the rotatable member enabling the rotatable member to be selectively locked to the housing for clockwise or counterclockwise rotation therewith about the axis of the housing, a plurality of generally radially oriented slots in the first rotatable member, a plurality of jaws, one slidably engaging each slot, to move inwardly and outwardly with respect to the housing axis for gripping a workpiece to be rotated by the wrench, each of said jaws having a gripping surface facing the axis, a second rotatable member concentric with the housing and rotatable with respect to the housing and first rotatable member, said second member having cams for engaging each of the jaws, each cam having an inner end that lies closer to the housing axis and an opposite end that lies farther away from the axis, a cam follower carried by each of the jaws and engaging a cam whereby rotation of the second rotatable member relative to the first member in one direction closes the jaws and in the other direction opens the jaws, and a second mechanism connecting the second rotatable member with the first rotatable member for preventing the jaws from releasing the workpiece when the workpiece is turned by the jaws.

11. An adjustable ratchet wrench as defined in claim 10 wherein the first mechanism is a ratchet mechanism.

12. An adjustable ratchet wrench as defined in claim 11 wherein the ratchet mechanism includes a circular gear in the first rotatable member and a pawl having teeth for engaging the circular gear.

13. An adjustable ratchet wrench as defined in claim 12 wherein the pawl is mounted on the housing and has two sets of teeth that alternately engage the gear.

14. An adjustable ratchet wrench as defined in claim 13 wherein the pawl is pivotally mounted on the housing enabling one or the other of the sets of teeth to selectively engage the gear.

15. An adjustable ratchet wrench as defined in claim 10 wherein the first rotatable member is circular and has a peripheral circular gear that forms part of the first mechanism, said first mechanism also including a pawl having teeth for engaging the circular gear.

16. An adjustable ratchet wrench as defined in claim 10 wherein the second rotatable member has means extending from the housing for enabling the user of the wrench to turn the second member to move the jaws.

17. An adjustable ratchet wrench as defined in claim 10 wherein the second rotatable member is disposed above the first rotatable member when the jaws extend downwardly from the housing.

18. An adjustable ratchet wrench as defined in claim 17 wherein gripping means are provided on the top of the second rotatable member for rotating the second member with respect to the housing.

19. An adjustable ratchet wrench as defined in claim 10 wherein the second mechanism is a ratchet mechanism.

20. An adjustable ratchet wrench as defined in claim 10 wherein the second mechanism includes a pawl carried by one of the rotatable members and a rack carried by the other rotatable member.

21. An adjustable ratchet wrench as defined in claim 19 wherein the ratchet mechanism in one position prevents the jaws from being opened.

22. An adjustable ratchet wrench as defined in claim 12 wherein the second mechanism includes a pawl carried by one of the rotatable members and a rack carried by the other rotatable member.

* * * * *